US010446907B2

(12) United States Patent
Patel et al.

(10) Patent No.: US 10,446,907 B2
(45) Date of Patent: Oct. 15, 2019

(54) IMPEDANCE SURFACE TREATMENT FOR MITIGATING SURFACE WAVES AND IMPROVING GAIN OF ANTENNAS ON GLASS

(71) Applicant: GM GLOBAL TECHNOLOGY OPERATIONS LLC, Detroit, MI (US)

(72) Inventors: Amit M. Patel, Santa Monica, CA (US); Timothy J. Talty, Beverly Hills, MI (US); Hyok Jae Song, Oak Park, CA (US); Keerti S. Kona, Woodland Hills, CA (US); James H. Schaffner, Chatsworth, CA (US); Duane S. Carper, Davison, MI (US); Eray Yasan, Canton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 99 days.

(21) Appl. No.: 15/426,600

(22) Filed: Feb. 7, 2017

(65) Prior Publication Data

US 2017/0237148 A1 Aug. 17, 2017

Related U.S. Application Data

(60) Provisional application No. 62/295,855, filed on Feb. 16, 2016.

(51) Int. Cl.

| | |
|---|---|
| ***H01Q 1/38*** | (2006.01) |
| ***H01Q 1/32*** | (2006.01) |
| ***H01Q 15/02*** | (2006.01) |
| ***H01Q 15/24*** | (2006.01) |
| ***H01Q 1/12*** | (2006.01) |
| ***H01Q 5/314*** | (2015.01) |
| ***H01Q 1/24*** | (2006.01) |
| ***H01Q 9/04*** | (2006.01) |
| ***H01Q 15/00*** | (2006.01) |

(52) U.S. Cl.
CPC ..... *H01Q 1/1271* (2013.01); *H01Q 1/241* (2013.01); *H01Q 1/3275* (2013.01); *H01Q 5/314* (2015.01);
(Continued)

(58) Field of Classification Search
CPC ..... H01Q 1/1271; H01Q 1/241; H01Q 5/314; H01Q 9/0485; H01Q 15/006;
(Continued)

(56) References Cited

U.S. PATENT DOCUMENTS 5,471,224 A * 11/1995 Barkeshli ..... H01Q 19/195 343/909
5,512,901 A * 4/1996 Chen ..... G01S 7/032 342/175
(Continued)

FOREIGN PATENT DOCUMENTS

CN 101345347 A 1/2009

OTHER PUBLICATIONS

Patel, Amit M. et al. "A Printed Leaky-Wave Antenna Based on a Sinusoidally-Modulated Reactance Surface" IEEE Transactions on Antennas and Propagation, vol. 59, No. 6, Jun. 2011, pp. 2087-2096.
(Continued)

*Primary Examiner* — Tho G Phan
(74) *Attorney, Agent, or Firm* — Cantor Colburn LLP

(57) ABSTRACT

An antenna assembly including a planar antenna formed on a dielectric substrate and a frequency selective impedance surface formed on the substrate and at least partially surrounding the antenna. The frequency selective impedance surface receives surface waves propagating along the dielectric substrate generated by the antenna, where the impedance surface mitigates negative effects of the surface waves by converting the surface wave energy into leaky-wave radiation, and also possibly providing some control of the radiation gain pattern of the antenna. In one embodiment, the dielectric substrate is vehicle glass, such as a vehicle windshield.

19 Claims, 4 Drawing Sheets

(52) U.S. Cl.
CPC ..... *H01Q 9/0485* (2013.01); *H01Q 15/006* (2013.01)

(58) Field of Classification Search
CPC ..... H01Q 1/3275; H01Q 1/12; H01Q 1/32; H01Q 1/38; H01Q 15/02; H01Q 15/24
See application file for complete search history.

(56) References Cited

U.S. PATENT DOCUMENTS

| | | | | |
|---|---|---|---|---|
| 7,639,207 | B2 * | 12/2009 | Sievenpiper ..... | H01Q 15/0013 343/700 MS |
| 7,847,737 | B2 * | 12/2010 | Kuroda ..... | H01Q 9/0407 343/700 MS |
| 8,941,095 | B2 * | 1/2015 | Song ..... | H01Q 1/1271 174/257 |
| 2007/0159395 | A1 * | 7/2007 | Sievenpiper ..... | H01Q 9/30 343/700 MS |
| 2010/0201584 | A1 | 8/2010 | Schaffner et al. | |
| 2017/0324138 | A1 * | 11/2017 | Talty ..... | H01Q 5/328 |

OTHER PUBLICATIONS

Fong, Bryan H. et al. "Scalar and Tensor Holographic Artificial Impedance Surfaces" IEEE Transactions on Antennas and Propagation, vol. 58, No. 10, Oct. 2010, pp. 3212-3221.
Chinese Office Action for Application No. 201710084267.7; 26 pages.

* cited by examiner

IMPEDANCE SURFACE TREATMENT FOR MITIGATING SURFACE WAVES AND IMPROVING GAIN OF ANTENNAS ON GLASS

CROSS-REFERENCE TO RELATED APPLICATIONS

This application claims the benefit of the priority date of U.S. Provisional Patent Application Ser. No. 62/295,855, titled, Impedance Surface Treatment for Mitigating Surface Waves and Improving Gain of Antennas on Glass, filed Feb. 16, 2016.

BACKGROUND OF THE INVENTION

Field of the Invention

This invention relates generally to an antenna assembly including an antenna mounted on a dielectric substrate and a frequency selective impedance surface surrounding the antenna and, more particularly, to an antenna assembly including an antenna mounted to a vehicle windshield or other non-conductive materials and a specially configured frequency selective impedance surface surrounding the antenna to reduce the effect of surface waves in the windshield or the other non-conductive materials.

Discussion of the Related Art

Modern vehicles employ various and many types of antennas to receive and transmit signals for different communications systems, such as terrestrial radio (AM/FM), cellular telephone, satellite radio, dedicated short range communications (DSRC), GPS, etc. Further, cellular telephone is expanding into 4G long term evolution (LTE) that requires two antennas to provide multiple-input multiple-output (MIMO) operation. The antennas used for these systems are often mounted to a roof of the vehicle so as to provide maximum reception capability. Further, many of these antennas are often integrated into a common structure and housing mounted to the roof of the vehicle, such as a "shark-fin" roof mounted antenna module. As the number of antennas on a vehicle increases, the size of the structures required to house all of the antennas in an efficient manner and providing maximum reception capability also increases, which interferes with the design and styling of the vehicle. Because of this, automotive engineers and designers are looking for other suitable areas on the vehicle to place antennas that may not interfere with vehicle design and structure.

One of those areas is the vehicle glass, such as the vehicle windshield, which has benefits because glass makes a good dielectric substrate for an antenna. For example, it is known in the art to print AM and FM antennas on the glass of a vehicle where the printed antennas are fabricated with the glass as a single piece. However, those known systems were generally limited in that they could only be placed in a vehicle windshield or other glass surface in areas where viewing through the glass was not necessary.

When an antenna is placed on a dielectric substrate energy generated by the antenna for both transmission and reception purposes gets coupled at least in part into the substrate where surface waves can be created. Those surface waves expand out from the antenna along the substrate until they reach the edge of the substrate, where they are either dissipated or coupled into conductive structures, such as where automotive glass is coupled to the metallic vehicle body. Thus, much of the energy that is to be radiated by the antenna is lost, reducing the efficiency and performance of the antenna.

Surface waves occur in situations where an electrically thick substrate compared to the wavelength supports surfaces waves. Surface waves can be created by printed antennas or antennas that are flush mounted to a substrate. This can be particularly problematic for wideband antennas, where the substrate happens to be electrically thick at some frequencies and electrically thin at other frequencies within the operating bandwidth of the antenna. Surface waves can also be created by incident energy from a distant source, that is, sources not directly mounted on the structure of interest. The presence of surface waves can result in undesired scattering, reduction in antenna gain, and can damage or interfere with the operation of other sensitive electronics on the same structure.

Holographic and sinusoidally modulated impedance surfaces have been used to control surface waves (slow waves) in a manner to achieve directed radiation. A bound surface wave mode is perturbed in a sinusoidal fashion to create slow leakage and directive radiation. To date, these surfaces have not been used as an integrated or retrofitted treatment to a separate antenna. Typically holographic and sinusoidally modulated surfaces are antennas themselves that must be customized based on their excitation source to achieve the specified radiation angle. Typically they are designed to control the transverse magnetic (TM) mode and required grounded substrates for this reason. Versions of the holographic antenna that do not require a grounded substrate and control the transverse electric (TE) mode have been demonstrated, but they require the thickness of the substrate to be varied in order to achieve radiation.

SUMMARY OF THE INVENTION

The present invention discloses and describes an antenna assembly including a planar antenna formed on a dielectric substrate and a frequency selective impedance surface formed on the substrate and at least partially surrounding the antenna. The frequency selective impedance surface receives surface waves propagating along the dielectric substrate generated by the antenna, where the impedance surface mitigates negative effects of the surface waves by converting the surface wave energy into leaky-wave radiation, and also possibly providing some control of the radiation gain pattern of the antenna. In one embodiment, the dielectric substrate is vehicle glass, such as a vehicle windshield.

Additional features of the present invention will become apparent from the following description and appended claims, taken in conjunction with the accompanying drawings.

DETAILED DESCRIPTION OF THE EMBODIMENTS

Figure 1:
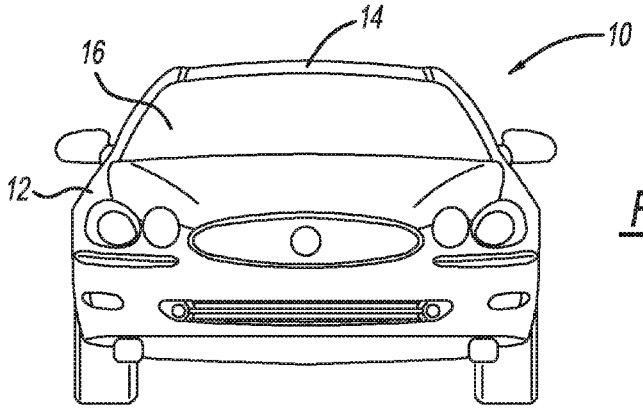
FIG. 1 is a front view of a vehicle showing a vehicle windshield.

The following discussion of the embodiments of the invention directed to an antenna assembly including an antenna mounted on a dielectric substrate and a frequency selective impedance surface surrounding the antenna is merely exemplary in nature, and is in no way intended to limit the invention or its applications or uses. For example, the discussion herein talks about the antenna being applicable to be mounted to automotive glass. However, as will be appreciated by those skilled in the art, the antenna will have application for other dielectric structures, such as plastics, other than automotive structures.

The present invention proposes an engineered electromagnetic surface treatment or "skin," referred to herein as a frequency selective impedance surface, that can be applied around an antenna, where the treatment allows gain enhancement and radiation pattern shaping of printed antennas by mitigating energy loss due to surface waves. The invention is particularly useful when dealing with co-planar waveguide (CPW) or co-planar stripline (CPS) antennas since the surface treatment does not require the dielectric substrate upon which the antenna is printed to be grounded. Traditional methods for mitigating surface waves require a grounded substrate or require alteration of the dielectric substrate such as through vias, air posts, graded thicknesses, etc.

The present invention mitigates the negative effects of surface waves by converting the surface wave energy into leaky-wave radiation. The invention also allows some control over the radiation pattern through gain enhancement and pattern smoothing. The invention is distinct from methods proposed in the past for mitigating surface waves in that it can be applied to structures where a grounded substrate is not present for CPW or CPS antennas, does not require vias, and allows the TE mode to be radiated. The invention is also distinct from holographic surfaces since holographic surfaces require a periodic modulation of surface properties in order to create radiation by periodically perturbing a bound surface-wave mode.

The present invention focuses on mitigating surface waves and converting them into useful radiation propagating in the desired directions, while maintaining a fairly omnidirectional pattern. The above mentioned prior art requires more physical space since it supports a slow wave and creates radiation by periodically perturbing this wave. The present invention uses a fast wave that is better for creating non-directive radiation and for getting the energy off the surface quickly, where less treatment area is required. The prior art requires that the impedance of the surface must vary periodically in order to achieve radiation. The present invention does not require periodic variation, does not require impedance variation at all since a properly designed leaky impedance surface will radiate even if the surface impedance is constant along the entire treatment (not modulated).

The present invention proposes a set of design parameters where the surface treatment can mitigate surface waves (specifically TE surface waves), improve antenna gain in desired directions, and smooth the radiation pattern without negatively effecting the antenna input match. Furthermore, the surface treatment operates without vias, air posts, or dielectric thickness modification and on a non-grounded substrate, all of which are present in some form in traditional surface-wave mitigation techniques. Additionally, the antenna of the invention functions properly when placed over a very large substrate (e.g. front windshield of an automobile) and while in a highly metallic environment of the vehicle. Many industries in need of antennas prefer smaller and even hidden antennas, which applies to the automotive industry as antennas for many wireless services need to be integrated into a limited space. If the antenna shape is patterned into a transparent conductor, the antenna will be less conspicuous.

In general, the surface treatment consists of a printed conductive cladding over an un-grounded dielectric substrate. The variations in the patterning (unit cells) are sub-wavelength. The treatment surrounds the antenna in order to "trap" the surface waves caused by the antenna and re-radiate the energy. When surface waves leaving the antenna impinge on the surface treatment, the energy is launched onto the impedance surface and converted to leaky-wave energy. Any energy that is reflected will eventually impinge on another part of the impedance surface. For the embodiments outlined herein the dimensions of the antenna can be 2.9 cm×3.0 cm, the outer dimensions of the surface treatment can be 200 mm×200 mm, the frequency of operation can be 5.9 GHz, and the window glass is regarded as the microwave substrate with a thickness of 4 mm and a relative permittivity of ~5.6.

The cladding and the substrate together are modeled as an impedance surface. Due to the un-grounded nature of the dielectric substrate, the surface waves that are supported will be TE mode waves. In order to convert the surface wave to a TE leaky mode as the waves impinge on the surface treatment, the surface treatment needs to make the overall surface substrate and conductive cladding appear inductive as shown in Table I below. One simple way to accomplish this is by a printed grid-like structure of metallic traces on the surface.

TABLE I

| | Inductive surface | Capacitive surface |
|---|---|---|
| TM | Bound mode (surface wave) | Leaky mode |
| TE | Leaky Mode | Bound mode (surface wave) |

Leaky waves occur when the tangential wave number $k_t$ is smaller than the free space wave number $k_0$, where:

$$k_0^2=k_z^2+k_t^2. \quad (1)$$

It is clear that $k_z$, i.e., the wave number normal to the surface, will be a real number and therefore represents radiation normal to the surface. The larger the magnitude of $k_z$, the higher the leakage rate of energy normal to the surface. A higher leakage rate corresponds to less area needed for the surface treatment and a less directive pattern, i.e., a broader beamwidth. For the TE mode, $k_z$ is related to the impedance of the surface by:

$$\eta_{surf}=j\eta_0 \cdot k_0/k_z. \quad (2)$$

Changing the impedance of the surface, i.e., the printed geometry, will change the leakage rate. In order for the surface to remain leaky, surface impedance values are restricted to be inductive (of the form jX where X is positive), while maintaining a fast wave ($k_1<k_0$). Slight variations of these equations allow TM modes to be controlled if a ground plane is present.

Once the desired surface impedance is determined, it is necessary to find the corresponding geometry that realizes that impedance. This can be done by sweeping geometries in a full wave eigenmode solver in order to find the geometry that has the same reflection properties as that of the idealized surface impedance boundary condition.

One embodiment of the invention includes a surface treatment applied to a DSRC antenna designed to be mounted on the inside of an automotive window glass. The antenna and surface treatment may consist of copper printed on kapton film and mounted to the automotive windshield. The copper can be replaced with a transparent conductor, such as indium tin oxide (ITO), silver nano-wire, zinc oxide (ZnO), etc., in order to make a transparent antenna for automotive glass.

The DSRC antenna can be a single layer co-planar antenna with a single feed that operates at 5.9 GHz and radiates linear polarization. The antenna may have a co-planar type of geometry where both radiator and ground plane conductors are patterned onto a thin flexible film substrate such as a copper kapton-film, which is ultimately mounted on a carrier substrate for a final installation. The window glass is regarded as the microwave substrate with a thickness of 4 mm and relative permittivity of ~5.6, where the windshield thickness of 4 mm is electrically thick compared to a wavelength at the operating frequency of 5.9 GHz for DSRC frequencies. The antenna radiator is fed by a co-planar waveguide and can be connected to a coaxial cable. The DSRC antenna demonstrated for a typical windshield glass mounting has a width of 3.0 cm×length of 2.9. The CPW feed structure has advantages, such as low radiation loss, less dissipation and easy integration with RF/microwave circuits, thus enabling a miniature hybrid or monolithic microwave integrated circuit (MMIC).

As discussed above, modern automotive vehicles are often equipped with multiple antennas to provide multiple wireless and location services, such as cell/PCS, GPS, global navigation satellite system (GNSS), satellite digital audio radio service (SDARS), etc. The multiple antennas are often packaged in a small housing and mounted on the roof. It is often desirable to move or hide the antennas from the roof to the windshield (or window glass) for automotive antennas. Styling concerns often prohibit multiple radomes or one large radome from being placed on the vehicle roof. The styling concern is overcome by using the thin film antennas of the invention to be mounted conformal to the window glass. It may also be necessary that the antennas be mostly transparent to minimize visual obscurity for the driver or passenger.

In order to fully integrate the antennas on the windshield glass, a preferred type of antenna structure is the co-planar structure where both the antenna and the ground conductors are printed on the same layer. Surface waves caused by a single antenna may interfere with the operation of other antennas also mounted on the same windshield. At the same time, the presence of surface waves indicates that the radiating antenna does not achieve the highest possible gain, where the antenna has low efficiency.

The proposed invention addresses the issues discussed above associated with a co-planar structure antenna solution. Some of the advantages of the proposed antenna include improvement in gain of the antenna in desired directions, smoothed out radiation pattern, good impedance match over a desired frequency band, i.e., does not negatively affect antenna matching, no ceramic antenna substrate, easily fabricated using the standard PCB manufacturing process, and can be directly integrated into the antenna design before fabrication or retrofitted onto the automotive glass at a later time.

The proposed invention is generally relevant for controlling surface waves excited by planar antennas or other electromagnetic sources. The invention as detailed herein operates without the need for a grounded substrate for the surface treatment. The antenna ground plane can be printed on the same surface as that of the antenna (co-planar format), eliminating the need for a grounded dielectric substrate or substrate modifications. If a grounded substrate is present (e.g. for applications other than mounting on windshield glass), slight modifications can be made to the design theory and procedure to design a surface treatment that is valid for the environment.

The present invention is directly relevant to windshield or window glass integrated (or printed) antennas for a vehicle, and it should also be useful for other types of craft. The present invention should be especially useful for vehicles with limited real estate in traditional antenna integration places such as the roof. The antenna of the invention could eventually be implemented using a transparent conductor, and window glass integrated antennas. It is also possible to implement the antenna using a non-transparent conductor if implemented in the blackout area of the roof. The invention has the added flexibility of being able to be retrofitted and placed around an antenna that has already been integrated into the vehicle.

By applying treatment to the antenna, surface waves can be mitigated and improve the performance of the antenna. The gain is improved at the desired angles and the radiation pattern is smoothed out. Furthermore, surface waves are contained, thus preventing them from interfering with other devices, and input match can be maintained.

Optimization of the surface treatment can be used to tailor the radiation at specific angles or tune the return loss at a specific frequency. More control can be achieved by making surfaces that are inhomogeneous, i.e., unit cells that vary along the surface. More complicated tensorial geometries (tensor impedance surfaces) can also be used. The boundary condition is then given by a matrix relating the tangential electric and magnetic fields and it is possible to control antenna polarization. With this adaptation, it is possible to make anisotropic and inhomogeneous surface treatments maximizing the designer's ability to control and scatter surface and leaky waves. Using periodic modulations of the surface impedance in order to scatter the surface impedance in order to scatter the surface wave is also a viable option but takes more real-estate.

The surface treatment could in theory be made tunable if the application and platform supported the complexity. As mentioned above, the surface treatment could also be made out of transparent conductors. For automotive applications, the transparency of the antenna must be better than 70%.

Figure 2:
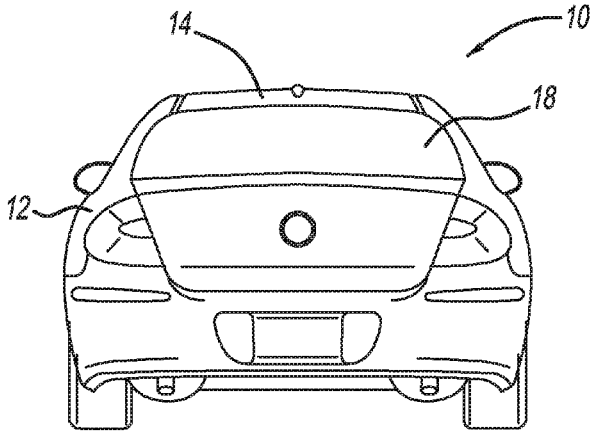
FIG. 2 is a rear view of the vehicle showing a vehicle rear window.

Examples of antenna structures of the type discussed above that include a frequency selective surface treatment are described below. FIG. 1 is a front view of a vehicle 10 including a vehicle body 12, roof 14 and windshield 16, and FIG. 2 is a rear view of the vehicle 10 showing a rear window 18.

Figure 3:
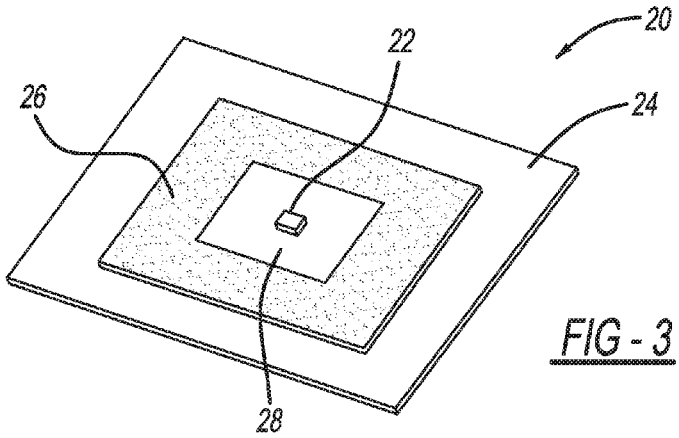
FIG. 3 is an isometric view of an antenna assembly including an antenna mounted on a glass substrate and surrounded by a frequency selective impedance surface.

FIG. 3 is an isometric view of an antenna assembly 20 including an antenna 22, such as a co-planar waveguide (CPW) or co-planar stripline (CPS) antenna, configured on a dielectric substrate 24, such as automotive glass. The antenna 22 is intended to represent any planar antenna suitable for the purposes discussed herein, such as a DSRC antenna, an AM/FM antenna, a GPS receiver antenna, a cellular antenna, etc. In one non-limiting embodiment, the antenna 22 operates in a frequency above 4 GHz. As discussed above, surface waves are generated in the dielectric substrate 24 through operation of the antenna 22, which reduces the power and performance of the antenna 22. In order to reduce the effect of the surface waves, the present invention proposes providing a frequency selective impedance surface 26 formed to the substrate 24 and defining an open area 28 in which the antenna 22 is located. A frequency selective surface is a device for creating a reactive surface, and is typically a periodic metal pattern on a dielectric substrate. Frequency selective surfaces are generally known in the art and come in a variety of configurations. For example, a frequency selective surface can include an array of loops with internal meanders that interact with the surface waves in the substrate 24.

Figure 4:
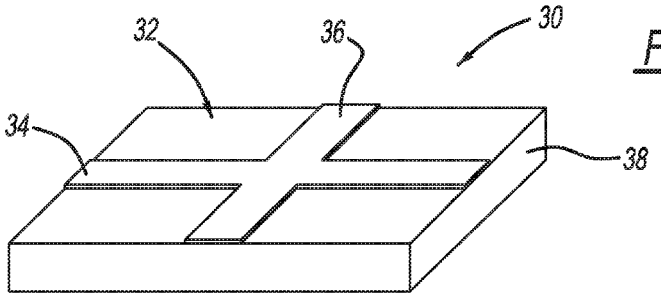
FIG. 4 is an isometric view of a frequency selective impedance surface unit cell.

Various types of interacting conductors for the surface 26 can be provided depending on the frequency band of interest, the dielectric constant $\varepsilon_r$ of the substrate 24, the thickness of the substrate 24, etc. FIG. 4 is an isometric view of a unit cell 30 of a frequency selective impedance surface 32 including cross-conductors 34 and 36 formed on a dielectric substrate 38. The unit cell 30 will repeat across the entire frequency selective impedance surface 26 in a desired configuration, where the width of the conductors 34 and 36, the dielectric constant $\varepsilon_r$ of the substrate 38, the thickness of the substrate 38, etc. all go into the design for the particular antenna 22.

The frequency selective impedance surface 26 can be designed to dissipate the surface waves in the dielectric substrate 24 so they do not travel to the edge of the substrate 24 or be designed as a gradient where the surface waves constructively interfere to generate antenna power in combination with the antenna signal. This helps prevent the surface waves from interacting with conductors that may surround the substrate 24, such as the vehicle roof 14, which may cause destructive interference of the waves and loss of signal power by reducing the signal nulls.

It is noted that for certain embodiments, the antenna assembly 20 may be at a location on the vehicle glass that is in area where the vehicle driver needs to see through. In these embodiments, the conductors that form the antenna 22 and the frequency selective impedance surface 26 can be made of transparent conductors, many of which are known in the art. In alternate embodiments, the substrate 24 may be part of other devices, such as architectural glass on buildings, where the conductors that make up the antenna 22 and the frequency selective impedance surface 26 are behind glass tinting and the like.

In one embodiment, the frequency selective impedance surface 26 has an identical periodicity in all directions and across the entire surface 26. However, other designs may require that the configuration of the conductors provide different interaction with the signal in different directions. For example, the frequency selective impedance surface 26 can be designed so that as the surface 26 is farther away from the antenna 22, the surface 26 interacts with the surface waves in the substrate 24 differently, which allows for beam steering of the antenna beam. For example, it may be desirable to steer the antenna beam up for satellite radio, across for cellular telephone, etc. For example, if the antenna assembly 20 is on the rear window 18 of the vehicle 10, which has a significant curvature, the frequency selective impedance surface 26 can be designed to direct the antenna beam more horizontal relative to the travel direction of the vehicle 10, which could increase the communications range.

Figure 5:
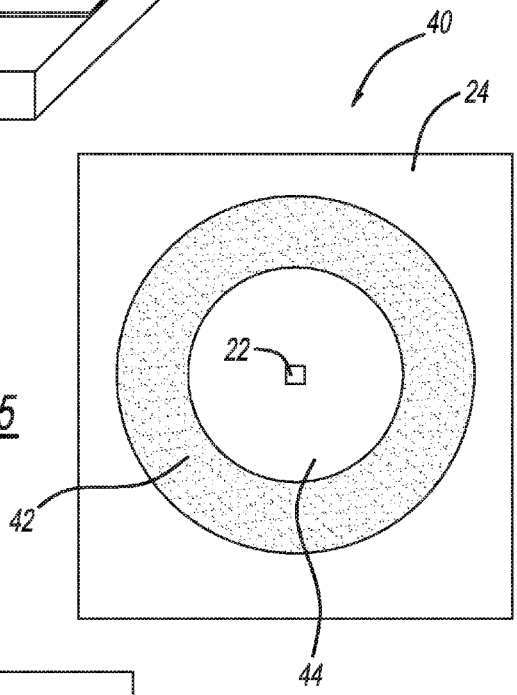
FIG. 5 is a top view of an antenna assembly including a round frequency selective impedance surface.

As mentioned, the design of the frequency selective impedance surface 26 can be application specific for the particular substrate and frequency band of interest, and the desired beam steering. FIG. 5 is a top view of an antenna assembly 40 similar to the antenna assembly 20, where like elements are identified by the same reference number. In this embodiment, the frequency selective impedance surface 26 is replaced with a frequency selective impedance surface 42 that is round and defines a round central opening 44. As with the antenna assembly 20, the frequency selective impedance surface 42 includes unit cells that are isotropic or homogeneous throughout the surface 42.

Figure 6:
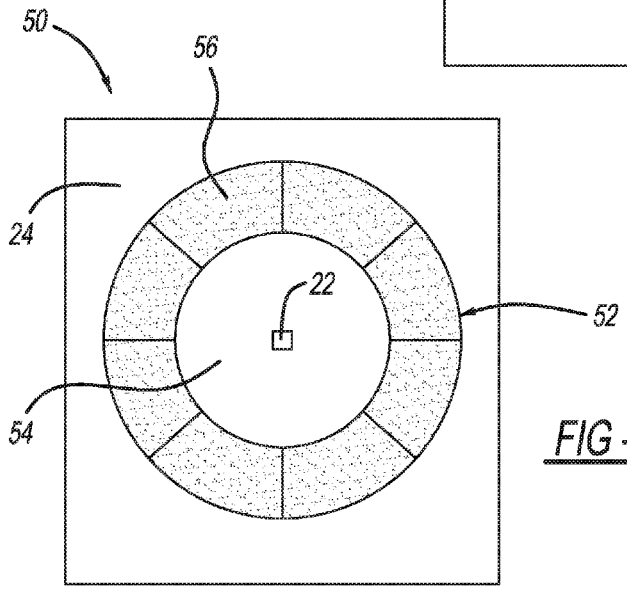
FIG. 6 is a top view of an antenna assembly including a round frequency selective impedance surface having different impedance sections.

FIG. 6 is a top view of an antenna assembly 50 similar to the antenna assembly 20, where like elements are identified by the same reference number. In this design, the frequency selective impedance surface 26 is replaced with a frequency selective impedance surface 52 that is round as shown, and defines a central opening 54 where the antenna 22 is located. In this design, the frequency selective impedance surface 52 is not homogeneous in all directions, but is separated into segments 56, here eight segments, where each of the segments 56 has a different impedance value $Z_1$-$Z_8$, so that the surface waves propagating in the dielectric substrate 24 interact differently in each of the sections 56 for beam steering and the like. The conductors in each of the sections 56 can be changed, such as changing the width of the conductors 34 and 36, to provide the different desired impedance.

Figure 7:
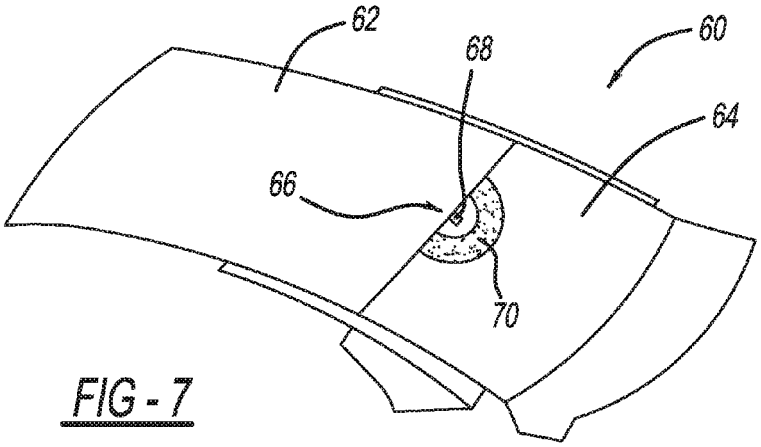
FIG. 7 is a cut-away, isometric view of a top portion of a vehicle showing an antenna formed on a vehicle windshield.

FIG. 7 is a cut-away, isometric view of a top area of a vehicle 60 showing a metal vehicle roof 62 and a vehicle windshield 64. In this embodiment, an antenna assembly 66 is provided at a top area of the windshield 64 and includes an antenna 68 that is positioned adjacent to the metal roof 62, as shown. A tinted blackout area 70 is shown on the windshield 64 and encircles the antenna 68, where the blackout area 70 is provided on most modern vehicles. In this design, the frequency selective impedance surface is designed in conjunction with the metal of the roof 62 that forms a co-planar ground plane.

Figure 8:
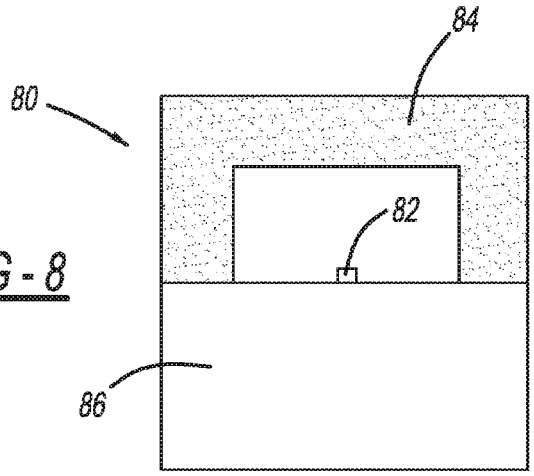
FIG. 8 is a top view of an antenna assembly including an antenna and a frequency selective impedance surface provided at an edge of a vehicle windshield.

FIG. 8 is top view of an antenna assembly 80 including an antenna 82 representing the antenna 68 showing how a frequency selective impedance surface 84 can be configured relative to a co-planar ground plane 86 representing the vehicle roof 62. In this embodiment, the size of the surface 84 is reduced in half to that of the surface 26, where the ground plane 86 prevents the need for the surface 84 at that location.

Figure 9:
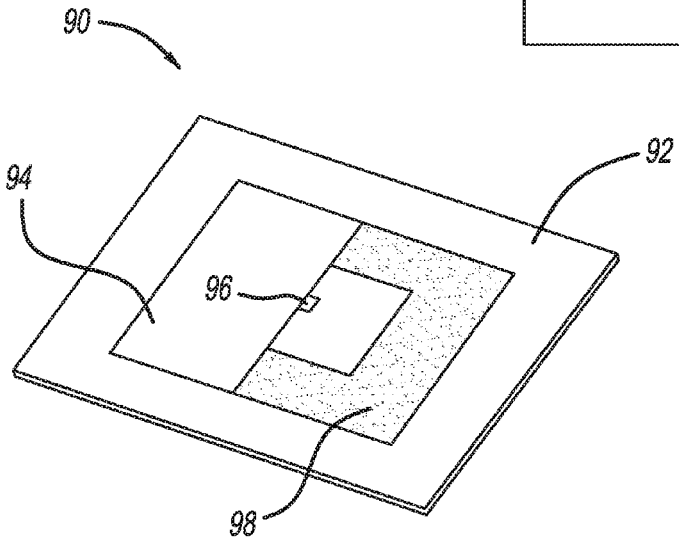
FIG. 9 is an isometric view of an antenna assembly including an antenna and a frequency selective impedance surface being formed as part of a ground plane.

For the embodiment discussed above, the windshield 64 is on a different plane than the vehicle roof 62. In an alternate embodiment, where the antenna may be on a different type of glass other than a vehicle windshield or rear window, the ground plane and the glass may be on the same plane, where the ground plane may actually be patterned on the same substrate. This embodiment is illustrated in FIG. 9 showing an isometric view of an antenna assembly 90 including a dielectric substrate 92, such as glass. The antenna assembly 90 includes a co-planar ground plane 94, an antenna 96 electrically coupled to the ground plane 94 and a frequency selective impedance surface 98 electrically coupled to the ground plane 94 and surrounding the antenna 96. In this design, the conductive printing technique that may form the ground plane 94 can also be employed to form the antenna 96 and the surface 98.

In other embodiments, the antenna and/or the frequency selective impedance surface may be provided on substrates other than the vehicle glass, for example, where one of the substrates may be the vehicle glass and another substrate may be a flexible adhesive backed polyethylene terephthalate (PET) film, or where the antenna and the frequency selective impedance surface are provided on different substrates and both of the substrates are adhered to the vehicle glass in a multi-layer configuration.

Figure 10:
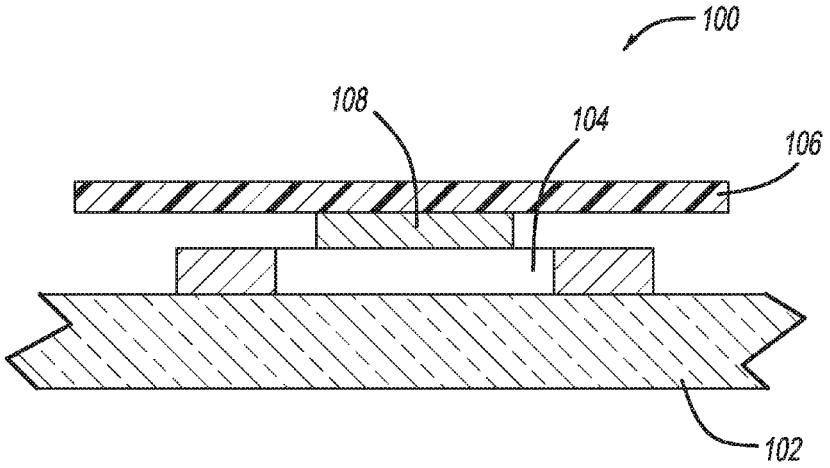
FIG. 10 is a cross-sectional view of an antenna assembly including a frequency selective impedance surface printed on vehicle glass and an antenna printed on a substrate and adhered to the glass.

FIG. 10 is a cross-sectional view of an antenna assembly 100 illustrating one non-limiting embodiment of this type. The antenna assembly 100 includes a dielectric substrate 102, such as vehicle glass, on which is printed, coated or otherwise fabricated a frequency selective surface 104, where the surface 104 has a semi-circular shape. A thin film substrate 106, such as a peel away adhesive sheet, is adhered to the substrate 102 over the frequency selective impedance surface 104 and includes an antenna 108 printed, coated or otherwise fabricated thereon.

Figure 11:
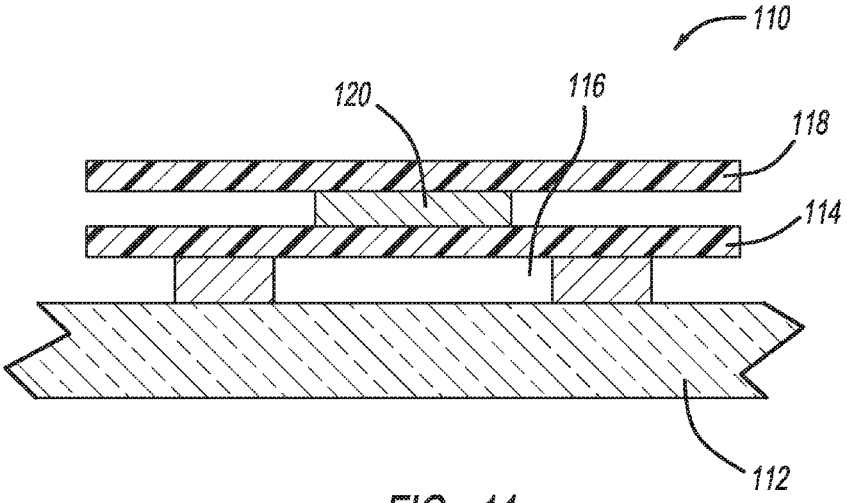
FIG. 11 is a cross-sectional view of an antenna assembly including an antenna and a frequency selective impedance surface printed on separate substrates and both being adhered to vehicle glass.

FIG. 11 is a cross-sectional view of an antenna assembly 110 illustrating another non-limiting embodiment of this type, where the antenna assembly 110 includes a dielectric substrate 112, such as vehicle glass. A thin film substrate 114, such as a peel away adhesive sheet, is adhered to the substrate 112 and includes a frequency selective surface 116 printed, coated or otherwise fabricated thereon so that the surface 116 faces and is positioned against the substrate 112, where the surface 116 has a semi-circular shape. A thin film substrate 118, such as a peel away adhesive sheet, is adhered to the substrate 114 and includes an antenna 120 printed, coated or otherwise fabricated thereon so the antenna 120 faces and is positioned against the substrate 114 opposite the surface 116. In another embodiment, the position of the substrates 114 and 118 can be reversed.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An antenna assembly, comprising:

at least one dielectric substrate;

a planar antenna formed on a surface of the at least one dielectric substrate, the planar antenna generating surface waves propagating along the at least one dielectric substrate;

a metal ground plane on the same plane as the antenna; and a frequency selective impedance surface formed on a surface of the at least one dielectric substrate, the frequency selective impedance surface being electrically coupled to the ground plane, wherein the frequency selective impedance surface and the ground plane completely surround the antenna on the dielectric substrate to define an open area on the dielectric substrate in which the planar antenna is formed, said frequency selective impedance surface receiving surface waves propagating along the at least one dielectric substrate generated by the antenna.

2. The antenna assembly according to claim 1 wherein the at least one dielectric substrate is one dielectric substrate, and wherein the antenna and the frequency selective impedance surface are formed on the same surface or opposing surfaces of the dielectric substrate.

3. The antenna assembly according to claim 1 wherein the at least one dielectric substrate is two dielectric substrates that are adhered to each other, and wherein the antenna is formed on one surface of one of the dielectric substrates and the frequency selective impedance surface is formed on one surface of the other dielectric substrate.

4. The antenna assembly according to claim 1 wherein the at least one dielectric substrate is three dielectric substrates that are adhered to each other, and wherein the antenna is formed on one surface of one of the dielectric substrates and the frequency selective impedance surface is formed on one surface of another one of the dielectric substrates.

5. The antenna assembly according to claim 1 wherein the frequency selective impedance surface completely surrounds the antenna.

6. The antenna assembly according to claim 1 wherein the frequency selective impedance surface is homogeneous in all directions.

7. The antenna assembly according to claim 1 wherein the frequency selective impedance surface is non-homogeneous and provides different impedance coupling for a signal generated by the antenna in different directions.

8. The antenna assembly according to claim 7 wherein the frequency selective impedance surface provides antenna beam steering.

9. The antenna assembly according to claim 1 wherein the frequency selective impedance surface is rectangular or circular.

10. The antenna assembly according to claim 1 wherein the at least one dielectric substrate is a vehicle glass.

11. The antenna assembly according to claim 10 wherein the vehicle glass is a vehicle windshield.

12. The antenna assembly according to claim 11 wherein the frequency selective impedance surface is provided under a tinted region in the vehicle windshield.

13. The antenna assembly according to claim 1 wherein the antenna is part of a communications system for terrestrial radio, cellular telephone, satellite radio, dedicated short range communications (DSRC), and GPS.

14. The antenna assembly according to claim 1 wherein the antenna includes transparent conductors.

15. The antenna assembly according to claim 1 wherein the ground plane, antenna and frequency selective impedance surface are all fabricated together.

16. An antenna assembly comprising:

vehicle glass;

a co-planar waveguide (CPW) antenna formed on a surface of the vehicle glass adjacent to a roof of the vehicle, the planar antenna generating surface waves propagating along the at least one dielectric substrate; and a frequency selective impedance surface formed on the same surface of the vehicle glass, the frequency selective impedance surface being electrically coupled to the roof, wherein the frequency selective impedance surface and the roof completely surround the antenna on the vehicle glass and define an open area on the vehicle glass in which the planar antenna is formed, said frequency selective impedance surface receiving surface waves propagating along the vehicle glass generated by the antenna.

17. The antenna assembly according to claim 16 wherein the frequency selective impedance surface is homogeneous in all directions.

18. The antenna assembly according to claim 16 wherein the frequency selective impedance surface is non-homogeneous and provides different impedance coupling for a signal generated by the antenna in different directions.

19. An antenna assembly comprising:

a vehicle windshield;

a co-planar waveguide (CPW) antenna formed on a surface of the windshield adjacent to a vehicle roof of the vehicle; and a frequency selective impedance surface formed on the surface of the windshield and electrically coupled to the vehicle roof, wherein the frequency selective impedance surface and vehicle roof completely surround the antenna on the windshield and define an open area on the windshield in which the antenna is formed, said frequency selective impedance surface receiving surface waves propagating along the dielectric substrate generated by the antenna.

* * * * *